US009468345B2

(12) United States Patent
Zhu

(10) Patent No.: US 9,468,345 B2
(45) Date of Patent: Oct. 18, 2016

(54) DUST COLLECTOR HAVING A HOSE CLAMP

(71) Applicant: SUZHOU CLEVA ELECTRIC APPLIANCE CO., LTD., Suzhou (CN)

(72) Inventor: Yanling Zhu, Suzhou (CN)

(73) Assignee: SUZHOU CLEV A ELECTRIC APPLIANCE CO., LTD., Suzhou (CN)

( * ) Notice: Subject to any disclaimer, the term of this patent is extended or adjusted under 35 U.S.C. 154(b) by 331 days.

(21) Appl. No.: 14/289,663

(22) Filed: May 29, 2014

(65) Prior Publication Data

US 2015/0342427 A1 Dec. 3, 2015

(51) Int. Cl.
*A47L 9/00* (2006.01)
*A47L 5/36* (2006.01)

(52) U.S. Cl.
CPC ..... *A47L 9/0036* (2013.01); *A47L 5/365* (2013.01)

(58) Field of Classification Search
CPC ... A47L 9/0036; A47L 9/0045; A47L 9/248; A47L 5/365
USPC ..... 15/323
IPC ..... A47L 9/00
See application file for complete search history.

(56) References Cited

U.S. PATENT DOCUMENTS

| | | | |
|---|---|---|---|
| 6,502,276 | B2 | 1/2003 | Iversen |
| 6,588,052 | B2 | 7/2003 | Iversen |
| 7,191,989 | B2 | 3/2007 | Berfield |
| 2007/0039118 | A1 | 2/2007 | Choi |
| 2007/0040376 | A1 | 2/2007 | Choi |
| 2008/0295278 | A1 | 12/2008 | Pelletier |
| 2011/0088201 | A1 | 4/2011 | Hess et al. |

FOREIGN PATENT DOCUMENTS

| | | | |
|---|---|---|---|
| CA | 2305955 | A1 | 10/2000 |

*Primary Examiner* — David Redding
(74) *Attorney, Agent, or Firm* — Perkins Coie LLP

(57) ABSTRACT

A dust collector having a hose clamp, comprising a dust collection power head, a dust bucket and a hose; wherein the dust collection power head is arranged on the dust bucket, one end of the hose is in communication with the dust bucket; and the dust collector further comprises a hose clamp which is comprised of a first baffle, a second baffle and an elastic resetting member; at least one of the first baffle and the second baffle is a rotatable baffle, and a resetting force generated by the elastic resetting member acts on the rotatable baffle. Due to action of a torsional spring, the first and second baffles can always clamp the hose tightly while accommodating the hose. When the operator takes the hose down, the second baffle can be opened automatically to a certain angle along with the operator's action, so the hose can be taken out.

10 Claims, 4 Drawing Sheets

DUST COLLECTOR HAVING A HOSE CLAMP

CROSS REFERENCE TO RELATED APPLICATION

This application claims priority to and incorporates by reference CN 201310216979.1 filed Jun. 4, 2013.

TECHNICAL FIELD

The present invention relates to a dust collector having a hose clamp.

BACKGROUND ART

It is necessary to accommodate the hose after using dust collector and unwind it for use next time. The hose is enwound on the dust collection power head through the snap joint, so it is troublesome to unwind the hose for use next time, and the hose cannot be accommodated and released quickly. At present, diameters of the common hoses on the market include 40 mm, 50 mm, 76 mm, 100 mm, 200 mm and so on. Different types of hoses are required for the dust collector in different environment. The dust collector is generally equipped with snap joint to accommodate hose; however, the existing snap joint is matched with a hose in pair, namely, one type of the hose can only be accommodated on one snap joint accordingly. There is uniqueness between the hose and the snap joint, so the snap joint cannot be used to accommodate different hoses.

SUMMARY OF THE INVENTION

The present invention provides a dust collector having a hose clamp, which comprises a dust collection power head, a dust bucket and a hose; wherein the dust collection power head is arranged on the dust bucket, one end of the hose can be in communication with the dust bucket; and the dust collector further comprises a hose clamp which is comprised of a first baffle, a second baffle and an elastic resetting member; at least one of the first baffle and the second baffle is a rotatable baffle, and a resetting force generated by the elastic resetting member acts on the rotatable baffle.

The elastic resetting member is a torsional spring, and a torsional spring shaft is arranged on the rotatable baffle, while the torsional spring is sleeved on the torsional spring shaft.

One end of the torsional spring is propped on the rotatable baffle, and the other end is propped on the dust collection power head.

The hose clamp is arranged on the dust collection power head.

The dust collection power head comprises an upper cover and a base, and the hose clamp is arranged on the upper cover.

The rotatable baffle is provided with a pivot separately at the two sides, and pivot holes used to accommodate the pivots are arranged accordingly on the dust collection power head.

Skid-proof ribs arranged at intervals are provided inside of at least one of the first baffle and the second baffle.

There are grooves on the hose, such that the grooves can be used to lock the skid-proof ribs.

The end of the first baffle forms a hook portion, and the second baffle is roughly S-shaped.

The first baffle and the second baffle forms a C-shaped cavity with the dust collection power head, and the C-shaped cavity is of roughly cylindrical extension.

The rotatable first baffle or second baffle can be opened according to size of the hose to be accommodated; if size of the hose is big, the angle of opening is big, and the angle of opening is small when size of the hose is small. The second baffle is S-shaped, so it can open automatically when the user put the hose into the hose clamp. Due to action of the torsional spring, the first and second baffles can always clamp the hose tightly. When the operator takes the hose down, the second baffle can be opened automatically to a certain angle along with the operator's action, so the hose can be taken out favorably. In addition, the baffle is also provided with hook portion and skid-proof ribs, so the grooves on the hose can be locked with the skid-proof ribs along the C-shaped cavity, thus the hose is clamped more tightly.

Therefore, compared with the prior art, the present invention can accommodate and release the hose more quickly, and it can be used for hoses of different diameters as well.

DETAILED DESCRIPTION OF THE PREFERRED EMBODIMENTS

Figure 1:
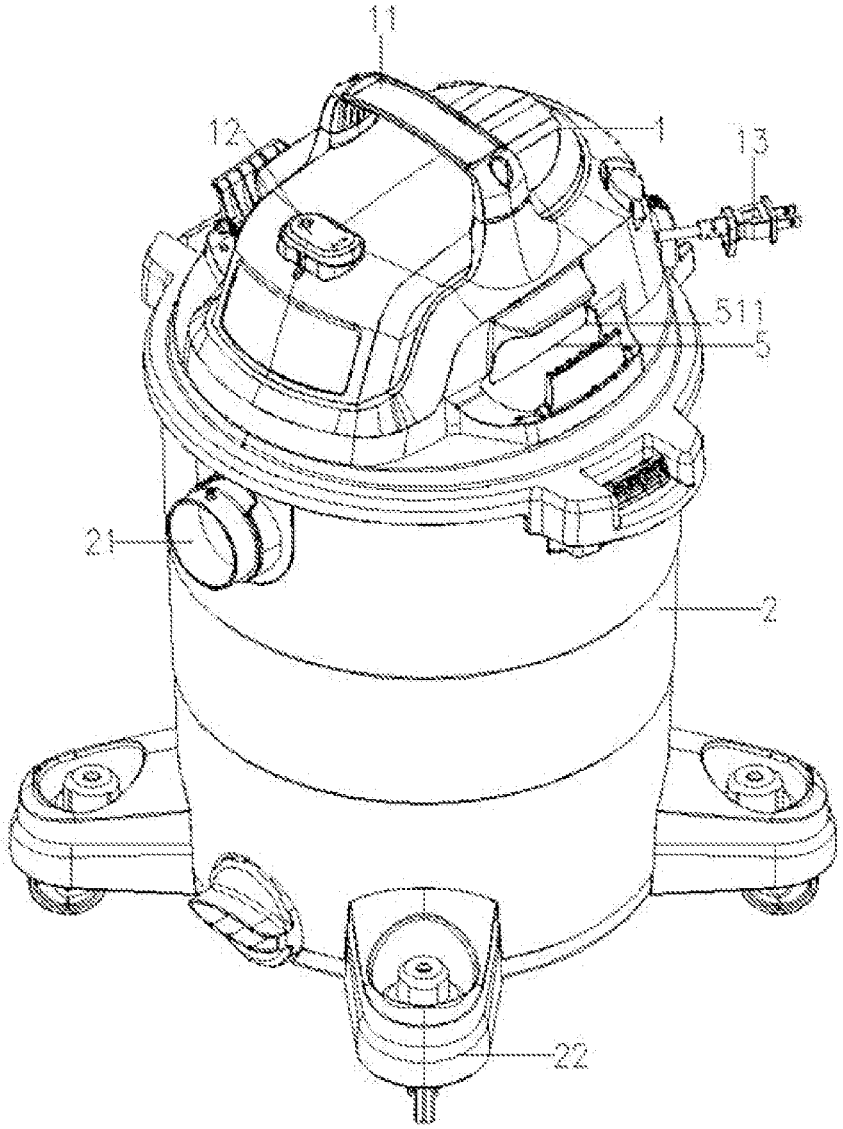
FIG. 1 is the schematic diagram of the whole dust collector.
Figure 3:
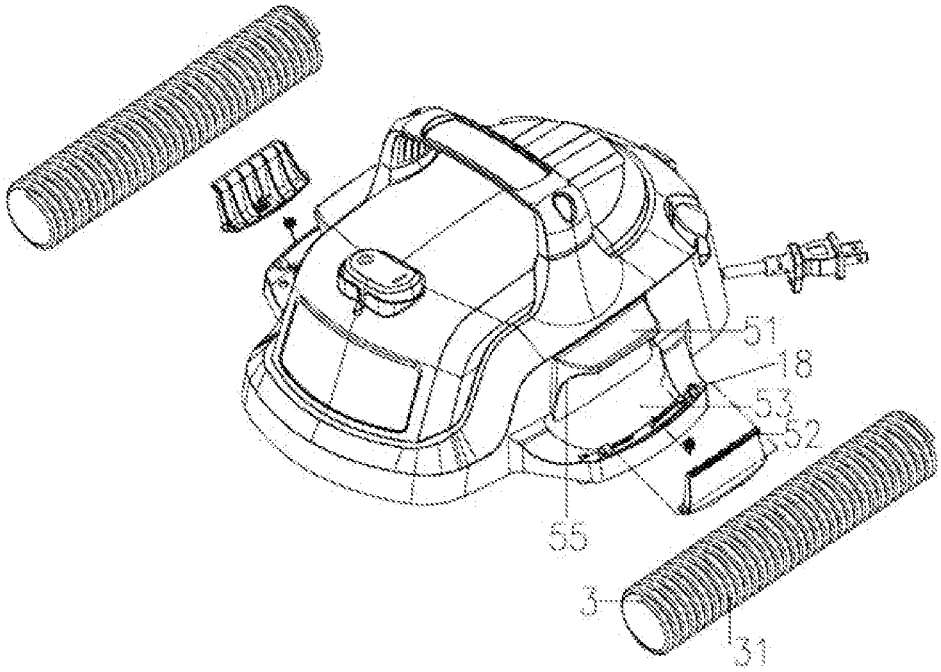
FIG. 3 is the exploded view of the dust collection power head.

The dust collector as shown in FIG. 1 comprises a dust collection power head 1, a dust bucket 3, a hose 3 (as shown in FIG. 3) and a filtering device 4; wherein the dust collection power head is arranged on the dust bucket 2, and the dust bucket 2 is provided with an air inlet 21, through which the working airflow enters the dust bucket of the dust collector. one end of the hose can be in communication with the dust bucket; and the dust collector further comprises a hose clamp which is comprised of a first baffle, a second baffle and an elastic resetting member; at least one of the first baffle and the second baffle is a rotatable baffle, and a resetting force generated by the elastic resetting member acts on the rotatable baffle. Universal wheels 22 are provided on bottom of the dust bucket, and a handle 11 is arranged on the dust collection power head 1. A switch 12 is arranged in front of the handle, and two hose clamps 5 are arranged at two sides of the handle. The hose clamps have a C-shaped cavity 511 of cylindrical extension separately. The dust collection power head 1 is further provided with a power plug 13 that is connected with a motor and the switch 12 in series through an extension wire.

Figure 2:
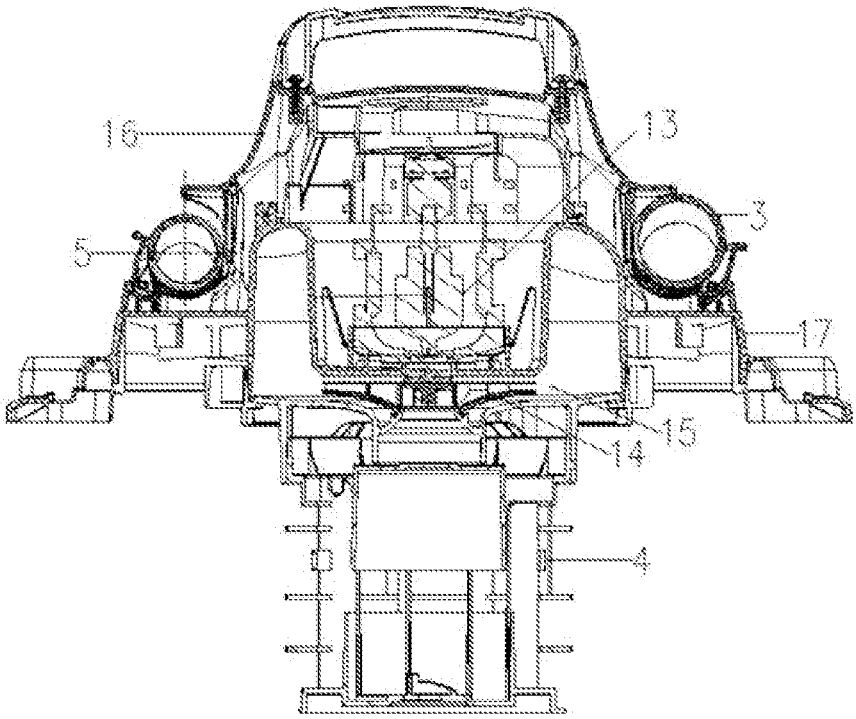
FIG. 2 is the sectional schematic diagram of the dust collection power head.

As shown in FIG. 2, the dust collection power head 1 comprises an upper cover 16 and a base 17, with a motor mounted inside; the lower end of the motor shaft is provided with a fan blade 14; the fan blade is placed in an impeller cavity 15 under the dust collection power head, and the lower part of the impeller cavity is in communication with the filtering device 4 and further in communication with the air outlet (not shown in figure); the motor drives the fan blade 4 to rotate at a high speed to generate a negative pressure inside of the impeller cavity 15, so the working airflow is absorbed the impeller cavity through the filtering device 4 and exhausted outside of the dust collector through the air outlet that is in communication with the impeller cavity. Two hose clamps are arranged on two ends of the upper cover of the dust collection power head, and the hose 3 is accommodated in the two hose clamps. The hose clamp is comprised of a first baffle 51 and a second baffle 52; the first baffle, the second baffle, and the upper cover wall 53 that forms the dust collection power head form a C-shaped cavity 511 of roughly cylindrical extension.

As shown in FIG. 3 to FIG. 6, the first baffle 51 and the second baffle 52 are respectively connected to the upper cover wall 53 of the dust collection power head 1, wherein the first baffle is integrated with the upper cover wall, and a hook portion 54 is formed at end of the first baffle to fix hose; the first baffle is connected with the upper cover wall 53 through a rib 55; the upper cover wall forms an arc-shaped area 531 at the bottom surface opposite to the first baffle, and the second baffle is arranged outside of the arc-shaped area; the second baffle 52 is roughly S-shaped, with the upper end having an outward arc-shaped extension 56. The second baffle is connected with the pivot holes 18 arranged on upper cover wall 53 through the pivots 57 at two sides thereof. Skid-proof ribs 58 are arranged at intervals between the two pivots, and the skid-proof ribs extends along the surface of the second baffle, with the width becoming smaller gradually from bottom up. When it is used to fix the hose, the ribs 58 can lock with the grooves 31 on the hose to present longitudinal movement of the hose. A torsional spring hole 59 is provided at the middle part of the bottom of the second baffle, and a torsional shaft 50 is provided in the torsional spring hole, while the torsional spring 6 is sleeved on the torsional spring shaft. One end of the torsional spring is propped outside of the second baffle, and the other end is propped on the upper cover wall 53.

Figure 4:
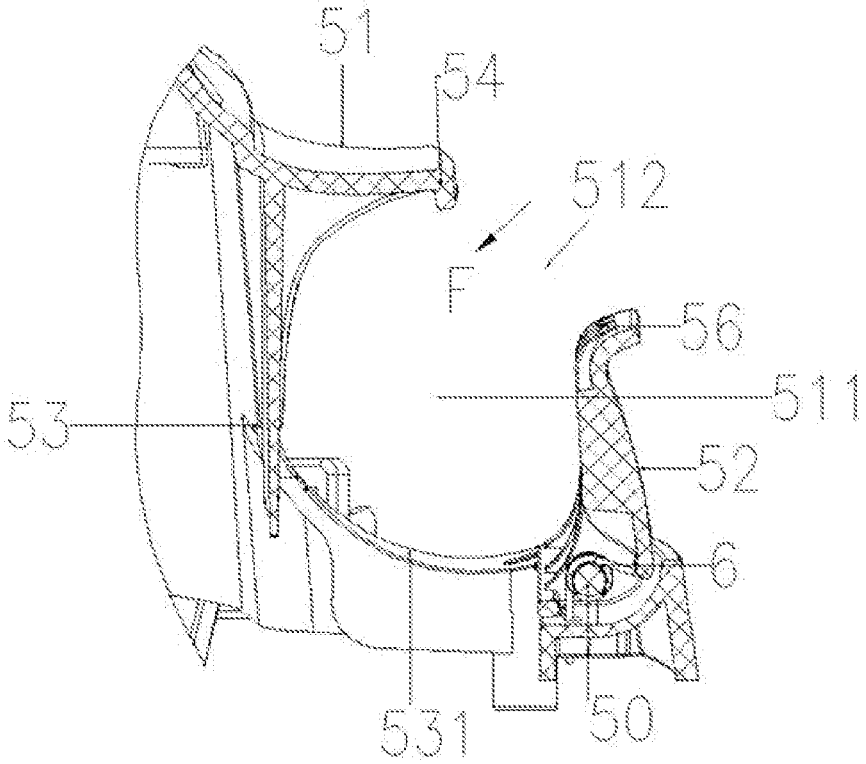
FIG. 4 is the sectional schematic diagram of the hose clamp.
Figure 5:
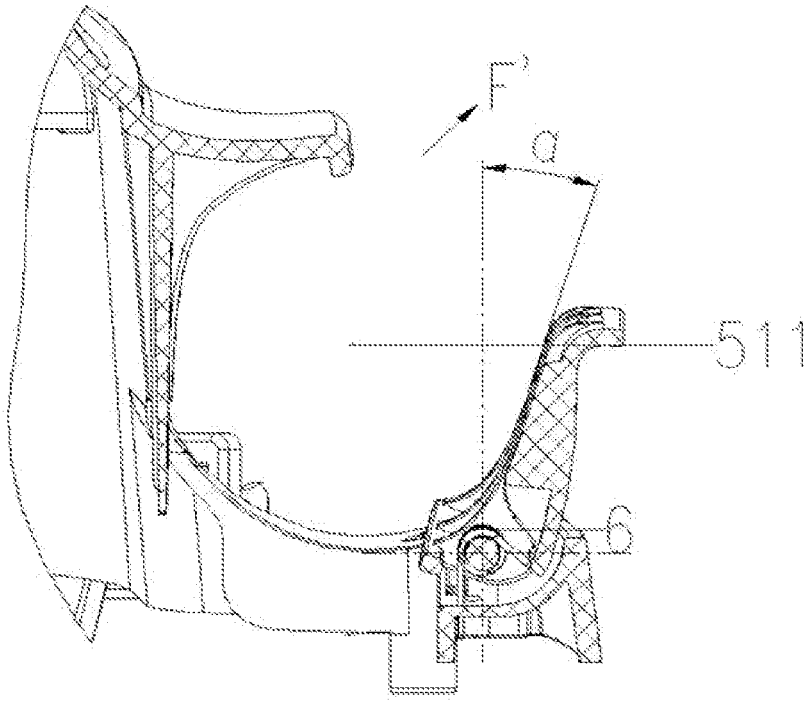
FIG. 5 is the sectional schematic diagram of the opened hose clamp.
Figure 6:
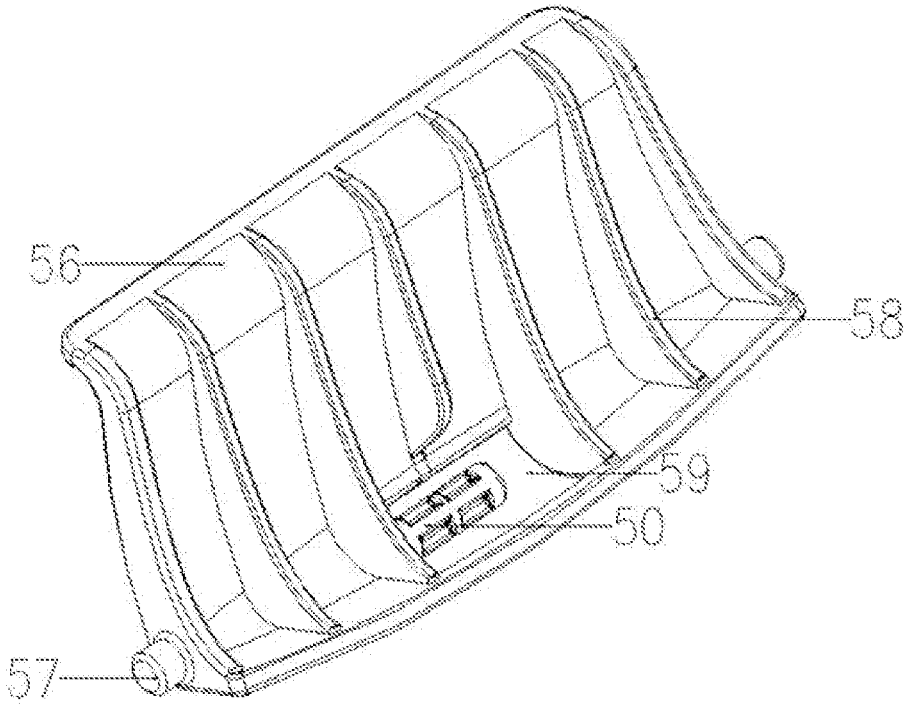
FIG. 6 is the schematic diagram of inside of the second baffle of the hose clamp.

As shown in FIG. 4 and FIG. 5, while accommodating the hose, the user holds the hose 3 to the opening 512 of the hose clamp, so the hose is contacted with the first baffle and outer end of the second baffle; at the same time, the user presses the hose downwards and inwards, the general direction being as shown as mark F; because of the arc-shaped extension 56 of second baffle, when the hose starts to enter the hose clamp, the hose clamp opens automatically, with angle a of about 0° to 18°. Due to action of a torsional spring, the hose clamp can always clamp the hose tightly from beginning to finishing of accommodating the hose 3. When it is necessary to take the hose down, the user only needs to pull the hose upwards and outwards towards the opening direction, with the general direction being as shown as F', and the hose clamp opens accordingly; after taking down the hose, the second baffle 53 returns to the initial position automatically, so the user can finish operations of accommodating and releasing hose in very short time.

In summary, the rotatable second baffle enables the hose clamp to open at different angles for hoses of different sizes. Due to action of a torsional spring, the hose clamp can always clamp the hose tightly, and even the hose with a small diameter cannot fall off from the hose clamp. Therefore, compared with the prior art, the present invention can accommodate and release the hose more quickly, and it can further be used for hoses of different diameters as well.

The above embodiment is the preferred embodiment of the present invention, there are more available embodiments based on the spirit of the present invention. For example, the first baffle is rotatably connected with the upper cover wall, so as to clamp and release the hose through rotation of the torsional spring and the first baffle. And the same technical effect can be realized if the first baffle and the second baffle are rotatably connected with the upper cover wall at the same time. Therefore, any modification and change made on the basis of the conception of the present invention by the persons skilled in the art shall belong to the protective scope of the present invention.

What is claimed is:

1. A dust collector having a hose clamp, comprising a dust collection power head, a dust bucket and a hose; wherein the dust collection power head is arranged on the dust bucket, one end of the hose is in communication with the dust bucket; and the dust collector further comprises a hose clamp which is comprised of a first baffle, a second baffle and an elastic resetting member; at least one of the first baffle and the second baffle is a rotatable baffle, and a resetting force generated by the elastic resetting member acts on the rotatable baffle.

2. The dust collector having a hose clamp according to claim 1, wherein the elastic resetting member is a torsional spring, and a torsional spring shaft is arranged on the rotatable baffle, while the torsional spring is sleeved on the torsional spring shaft.

3. The dust collector having a hose clamp according to claim 2, wherein one end of the torsional spring is propped on the rotatable baffle, and the other end is propped on the dust collection power head.

4. The dust collector having a hose clamp according to claim 1, wherein the hose clamp is arranged on the dust collection power head.

5. The dust collector having a hose clamp according to claim 4, wherein the dust collection power head comprises an upper cover and a base, and the hose clamp is arranged on the upper cover.

6. The dust collector having a hose clamp according to claim 4, wherein the rotatable baffle is provided with a pivot separately at the two sides, and pivot holes used to accommodate the pivots are arranged accordingly on the dust collection power head.

7. The dust collector having a hose clamp according to claim 1, wherein skid-proof ribs arranged at intervals are provided inside of at least one of the first baffle and the second baffle.

8. The dust collector having a hose clamp according to claim 7, wherein there are grooves on the hose, such that the grooves lock with the skid-proof ribs.

9. The dust collector having a hose clamp according to claim 1, wherein the end of the first baffle forms a hook portion, and the second baffle is roughly S-shaped.

10. The dust collector having a hose clamp according to claim 1, wherein the first baffle and the second baffle forms a C-shaped cavity with the dust collection power head, and the C-shaped cavity is of roughly cylindrical extension.

* * * * *